United States Patent [19]

Kammerer, Jr. et al.

[11] 4,030,554

[45] June 21, 1977

[54] BORE HOLE AIRHAMMER AND ANVIL BIT

[75] Inventors: Archer W. Kammerer, Jr., Columbus, N.C.; Alfred R. Curington, Inman, S.C.

[73] Assignee: Bakerdrill, Inc., Spartanburg, S.C.

[22] Filed: July 7, 1975

[21] Appl. No.: 593,692

[52] U.S. Cl. ..... 173/17; 173/78; 173/80; 173/132

[51] Int. Cl.[2] ..... B23Q 5/027

[58] Field of Search ..... 173/15, 16, 17, 66, 173/58, 64, 73, 78, 80, 128, 132, 133; 175/410

[56] References Cited

UNITED STATES PATENTS

| | | | |
|---|---|---|---|
| 3,136,375 | 6/1964 | Lear et al. | 173/16 |
| 3,595,323 | 7/1971 | Schindler | 173/73 |
| 3,735,820 | 5/1973 | Curington | 173/80 X |
| 3,738,435 | 6/1973 | Bronson | 175/410 X |
| 3,866,746 | 2/1975 | Curington | 173/78 X |

*Primary Examiner*—Ernest R. Purser
*Assistant Examiner*—Richard E. Favreau

[57] ABSTRACT

An airhammer embodies an outer housing structure connectible to a rotatable drill pipe string through which compressed air is conducted. A hammer piston reciprocates in the housing structure, compressed air being directed alternately to the upper and lower ends of the piston to effect its reciprocation in the structure, each downward stroke inflicting an impact blow upon the anvil portion of an anvil bit extending upwardly within the lower portion of the housing structure. Upon elevating the airhammer off the bottom of the bore hole being drilled, the anvil bit drops downwardly of the housing structure to open one or more air bleeding grooves in the anvil bit, compressed air in the housing structure bleeding quickly through such grooves and preventing or stopping the hammer piston from reciprocating and impacting against the anvil bit. A step is also placed in the bit at the junction between its head and shank to break the stress wave, incident to the hammer piston striking the anvil bit, before the wave reaches the bit head, thereby reducing the induced stress at the head and shank junction, which increases considerably the fatigue life of the bit, thereby preventing breaking of the shank at its junction with the bit head.

26 Claims, 9 Drawing Figures

BORE HOLE AIRHAMMER AND ANVIL BIT

The present invention relates to apparatus for drilling a bore hole in a formation, and more particularly to a pneumatically operated apparatus that imparts a percussive action to a drill bit while the latter is preferably being rotated, in order that the bit may cover substantially the full area of the bore hole bottom. The invention is also directed to an improvement in the drill bit itself.

Prior airhammers include a hammer piston reciprocating in a housing structure to impart repeated impact blows to an anvil integral with the drill bit to drill a bore hole. The housing structure is secured to a string of drill pipe through which required drilling weight is imposed on the drill bit and through which the airhammer and bit are rotated to insure a percussive drilling action on substantially the entire area of the bottom of the bore hole. Upon raising the airhammer, the hammer piston sometimes tends to continue reciprocating and impacting against the anvil bit, which is an undesirable action. In addition, during normal operation of the airhammer, the impacting of the hammer or piston against the anvil bit creates longitudinal stress pulses which travel through the bit from the anvil end to the face end of the bit. These stress pulses or stress waves remain constant in magnitude until such time as they encounter a change in cross-sectional area of the bit. At these changes in cross-sectional area, part of the pulse is reflected back and a smaller magnitude pulse continues in the original direction. The amount of energy reflected back at the junction between the bit shank and bit head, which is of much larger cross-sectional area than the shank, is rather large. The stress pulses are transmitted back and forth through the anvil and bit between the anvil end and face of the bit, eventually creating fatigue failure at the junction between the bit shank and head.

In accordance with the present invention, the hammer piston does not continue reciprocating upon elevation of the air-hammer and bit off bottom, since the compressed air in the air-hammer apparatus bleeds through grooves, or the like, which are opened as the lower portion of the anvil and bit drops downwardly with respect to the airhammer housing. The opening of the bleeder grooves prevents the compressed air from acting alternately upon the upper and lower ends of the hammer piston, which is essential to effecting its reciprocation during normal operation of the apparatus in drilling a bore hole. The bleeder grooves provide an added benefit of discharging compressed air into the area between the bit head and the lower end of the housing structure to keep the area therebetween clean of cuttings when the bit is hanging downwardly of the housing structure, as a result of elevating the apparatus above the bottom of the bore hole. The maintenance of the area between the bit head and lower portion of the housing structure clean of cuttings greatly reduces the wear that previously occurred between the parts referred to.

The invention has the further objective of greatly extending the life of the anvil and bit by preventing the shank portion of the bit from breaking off at its junction with the head of the bit. By providing a step at the junction, the stress waves flowing back and forth through the anvil and bit are broken before they reach the head-shank intersection, which reduces the induced stress at such intersection to a level where the fatigue life of the anvil bit is greatly increased, to the point where the fatigue life exceeds the service life of the usual carbide buttons mounted in the head and which impact against the formation during the drilling operation.

This invention possesses many other advantages, and has other objects which may be made more clearly apparent from a consideration of a form in which it may be embodied. This form is shown in the drawings accompanying and forming part of the present specification. It will now be described in detail, for the purpose of illustrating the general principles of the invention; but it is to be understood that such detailed description is not to be taken in a limiting sense.

Referring to the drawings:

FIGS. 1*a*, 1*b* and 1*c* together constitute a longitudinal section through an airhammer apparatus embodying the invention with the parts in one relative condition, FIGS. 1*b* and 1*c* being lower continuations of FIGS. 1*a* and 1*b*, respectively;

FIGS. 2*a* and 2*b* are views similar to FIGS. 1*a* to 1*c* disclosing the hammer piston portion of the apparatus in elevated position as compared to the position disclosed in the prior Figures, FIG. 2*b* being a lower continuation of FIG. 2*a;*

FIGS. 3*a* and 3*b* together constitute a longitudinal section similar to FIGS. 2*a* and 2*b*, illustrating the relative position of the parts upon lifting the apparatus off the bottom of the bore hole being drilled;

Figure 1A:
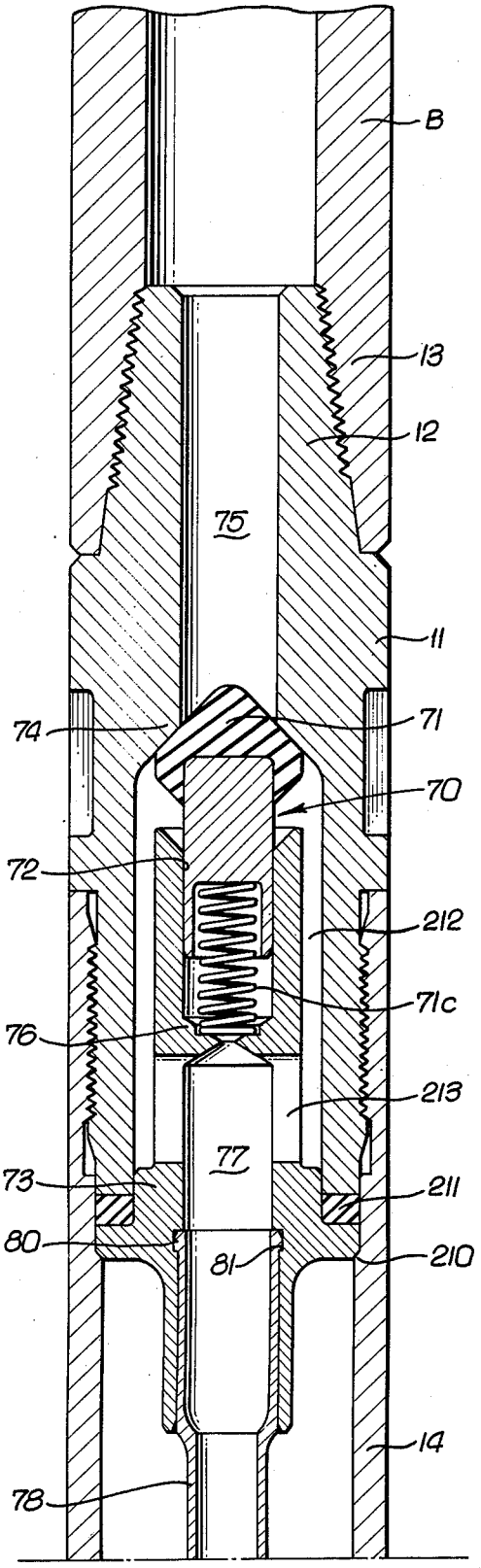

As shown in the drawings, an airhammer apparatus A is provided that is secured to the lower end of a string of drill pipe B, by means of which the apparatus is rotated to correspondingly rotate an impact anvil bit C used for drilling a bore hole D, the apparatus delivering repeated impact blows upon the anvil bit by forcing compressed air down the drill pipe for actuating the apparatus and for cleaning the cuttings from the bottom E of the hole. The apparatus is relatively simple, consisting of an elongate housing structure 10 that includes an upper sub 11 having an upper threaded pin 12 for threaded attachment to the lower end 13 of the string of drill pipe extending to the drilling rig (not shown) at the top of the bore hole D. This sub is threadedly secured to the upper portion of an elongate housing section 14, which can be of one piece, the lower end of which is threadedly secured to a lower housing head or drive member 15, the lower end 16 of the housing section bearing against an upwardly facing shoulder 17 formed on the head.

An elongate anvil portion 18 of the anvil bit C is piloted upwardly within the drive member 15 and lower portion 19 of the housing section 14, a hammer piston 20 being reciprocable in the housing section above the anvil 18 to deliver repeated impact blows thereagainst. The anvil is preferably formed integrally with the drill bit portion 21 of the anvil bit, which has suitable cutting elements 22 (such as sintered carbide buttons) mounted in its drilling face 23 for impacting against the bottom E of the bore hole, to produce cuttings therein, the cutting elements 22 also acting against the side of the bore hole adjacent to its bottom to insure the production of a bore hole D of the desired diameter.

During the reciprocation of the hammer piston 20 in the housing to deliver impact blows upon the anvil bit, the drill pipe string B and housing structure 10 are rotated at a desired speed, such as 10 to 20 r.p.m., to correspondingly rotate the anvil bit C and insure an impacting action of the cutting members 22 over substantially the entire cross-sectional area of the bottom E of the hole. During the impacting action, suitable drilling weight is imposed on the anvil bit through the drill pipe string B and the housing structure 10, such drilling weight being transferred from the lower end 24 of the housing head or drive member 15 to an upwardly facing shoulder 25 of the bit head 25*a*, which extends laterally from the bit shank 25*b* of smaller diameter than the bit head. The rotary drive itself is transferred from the housing structure 10 to the anvil 18 through a slidable spline type of connection 26, which can assume several different forms, the particular drive connection illustrated constituting no portion of the present invention. Substantially the same drive connection is illustrated in U.S. Pat. No. 3,866,746, to which attention is directed.

In general, the upper groove of the anvil has circumferentially spaced elongate grooves 27, in which segments 28 are disposed, these segments being carried in circumferentially spaced windows 29 in the drive member 15. The grooves 27 are substantially longer than the length of the segments 28, permitting relative longitudinal movement of the anvil bit C with respect to the housing structure 10. The rotary effort is transferred from the housing section 14 to the drive member 15 by virtue of the threaded connection 30*d*, and from the sides 29*a* of the openings 29 to the segments 28, from where the turning effort is transmitted through the segments 28 and groove sides 27*a* to the anvil bit C.

The housing section 14 includes an upper inner cylindrical housing wall 30, the lower end 31 of which constitutes an upper housing flow control corner at the upper end of an elongate internal circumferential exhaust groove 32 of a substantially larger internal diameter than the diameter of the inner cylindrical housing wall 30. Disposed substantially below the lower end 33 of the exhaust groove, the housing section is provided with a lower inner cylindrical housing wall 34, which may be of the same internal diameter as the upper housing wall 30, the upper end of the lower wall being a housing lower flow control corner 33. The lower end 35 of the lower inner cylindrical housing wall 34 provides a bypass corner at the upper end of an enlarged internal diameter circumferential bypass groove 36. Similarly, the housing has an enlarged internal diameter circumferential bypass groove 36*a* immediately above the lower corner 33.

The elongate hammer piston 20 includes an upper piston portion 37 having an external diameter 37*a* conforming to the diameter of the upper inner cylindrical housing wall 30, this upper piston portion terminating at the upper end 38 of an elongate external circumferential exhaust groove 39 or piston relief portion of a lesser external diameter than the upper piston portion 37. This external exhaust groove terminates at a lower piston portion 40 having an external diameter conforming to the internal diameter of the lower inner cylindrical housing wall 34. Below its lower piston portion, the hammer is of a reduced external diameter 41, providing a downwardly facing shoulder 42 which may, upon removal of the anvil bit C from the housing 10, engage a limit ring 43 mounted in the housing section 14, to prevent the piston 20 from inadvertently dropping out of the housing structure.

Figure 4:
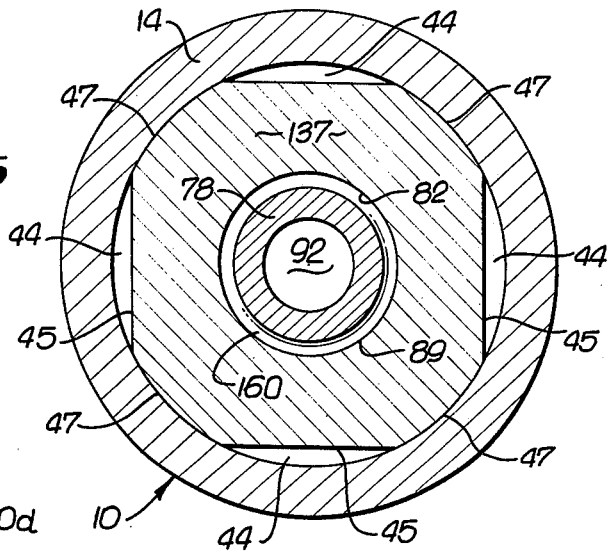
FIG. 4 is an enlarged cross-section taken along the line 4—4 on FIG. 1*b;*.
Figure 5:
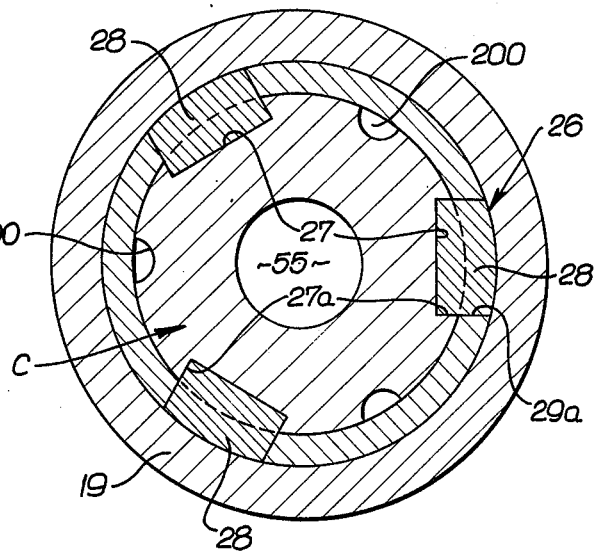
FIG. 5 is an enlarged cross-section taken along the line 5—5 of FIG. 1*c*.

The hammer piston has an upper guide portion 137 separated by a circumferential groove 138 from the upper piston portion 37. This upper guide portion has a plurality of circumferentially spaced relief portions 44 (FIG. 4) which may be formed by chords 45 extending from the upper end of the groove 138 to the upper end 46 of the guide portion 137, there being circumferentially spaced elongate arcuate sections 47 between the relief portions 44 having the same external diameter as the upper piston portion 37 and assisting in guiding the hammer piston 20 in its reciprocation along the inner wall of the housing section 14.

Figure 1B:
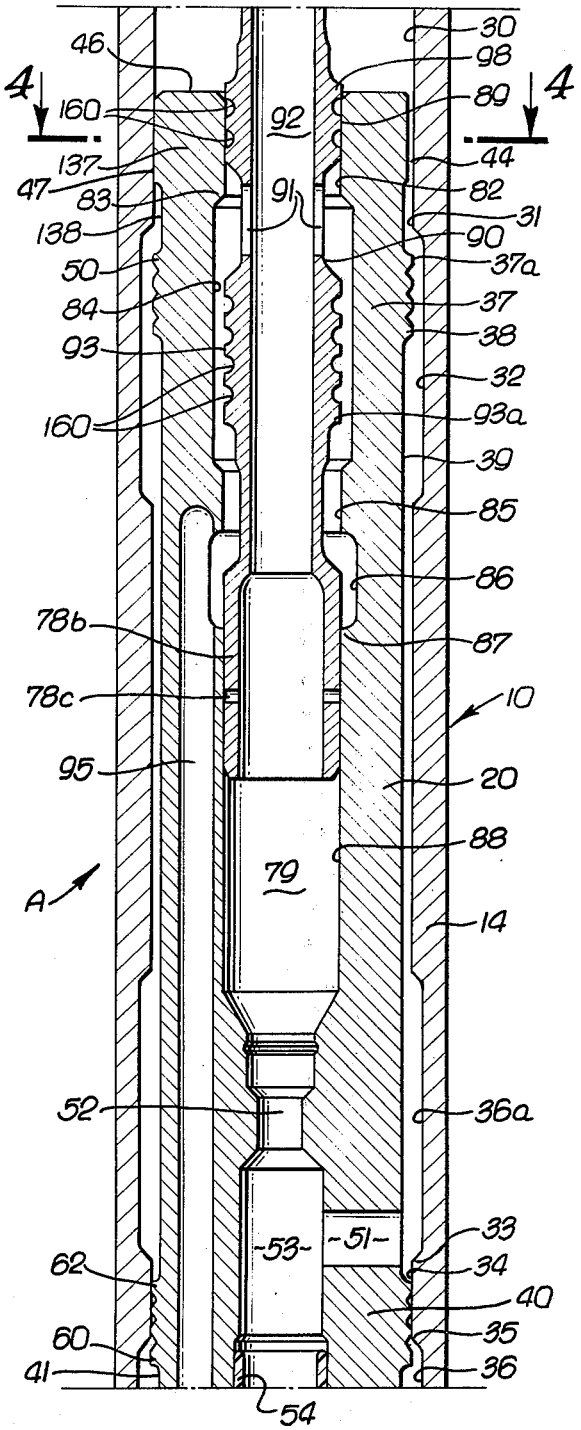
Figure 1C:
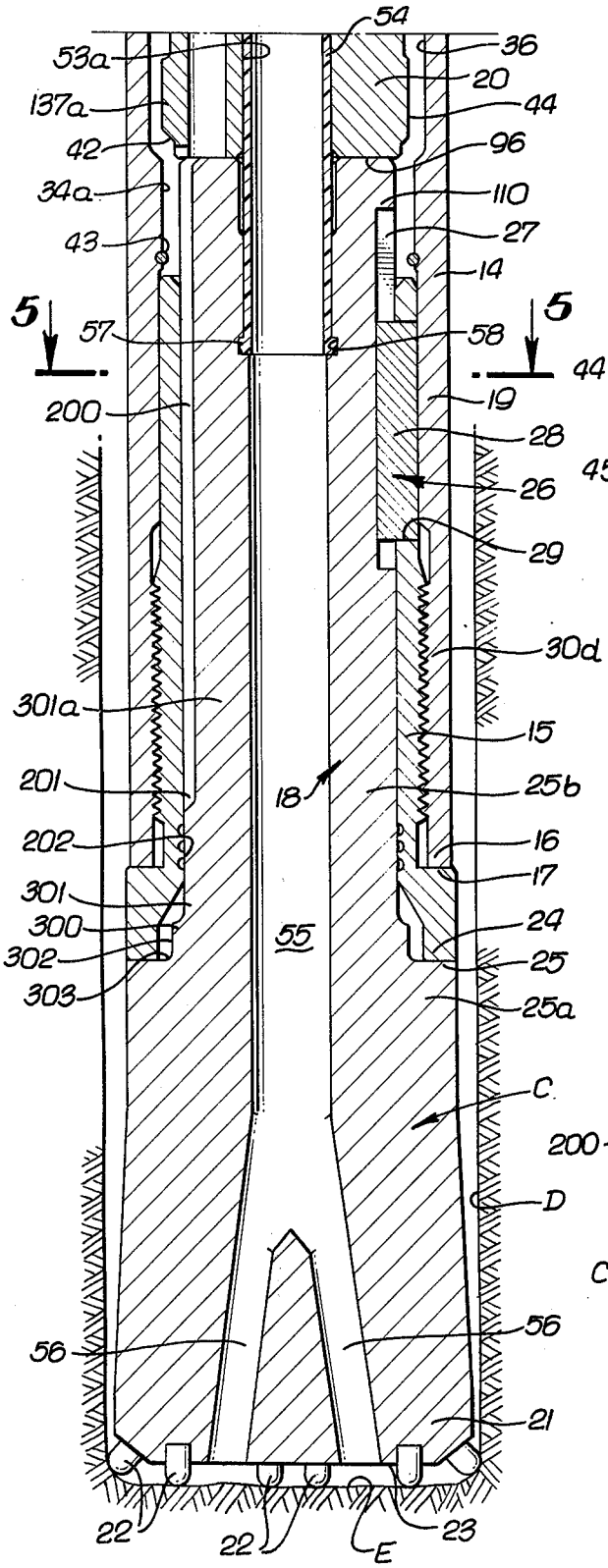

As described hereinbelow, when the hammer piston 20 is at the lower end of its stroke, as shown in FIGS. 1*a*, 1*b*, 1*c*, a flow control piston corner 50 at the upper end of the piston portion 37 is spaced below the upper housing flow control corner 31, allowing air in the housing above the piston 20 to flow down through the passages 44 and into the internal circumferential exhaust groove 32, around the upper piston portion 37, then through the lower portion of the groove 32 and the grooves 39 and 36*a* into radial exhaust ports 51, formed through the hammer piston below its intermediate piston passage restriction 52, that communicate with an elongate central piston cavity 53 into which an exhaust tube 54 extends upwardly from the anvil 18, the tube forming a continuation of the exhaust passage 53 and communicating with an exhaust passage 55 through the anvil and one or a plurality of exhaust passages 56 extending downwardly through the bit 21 and opening outwardly thereof for the purpose of removing the cuttings from the bottom E of the hole. The tube 54 makes a slidable seal with the wall 53*a* of the piston cavity 53, being secured to the anvil 18 by a lower outwardly extending tube flange 57 being received within an inner circumferential groove 58 in the anvil. The tube may be made of an elastic material, such as Delrin, which permits it to be inserted within the anvil passage, the flange 57 contracting sufficiently until it is opposite the circumferential groove 58, whereupon the tube flange can snap outwardly into the groove 58 and thereby lock the tube 54 to the anvil 18.

When the piston 20 is shifted upwardly within the housing on its return stroke, the return air corner 60 at the lower end of the lower piston portion 40 will be disposed above the housing lower flow control corner 33 (FIGS. 2*a*, 2*b*), whereupon the compressed air below the piston can exhaust into the internal circumferential housing groove 36*a* and flow through the exhaust ports 51 and exhaust passages 53, 55, 56 to the bottom E of the bore hole. At this time, the upper flow control piston corner 50 will be disposed above the upper housing flow control corner 31, which will seal the upper piston portion 37 against the upper inner cylindrical housing wall 30, whereupon compressed air can drive the piston 20 downwardly on its hammer or power stroke. When the return air corner 60 moves below the housing lower flow control corner 33, the air below the piston and within the housing, which remains after the lower piston portion 40 is closed within the lower end of the cylindrical housing wall 34, is subject to compression, but such air will be at a relatively low pressure.

Figure 2A:
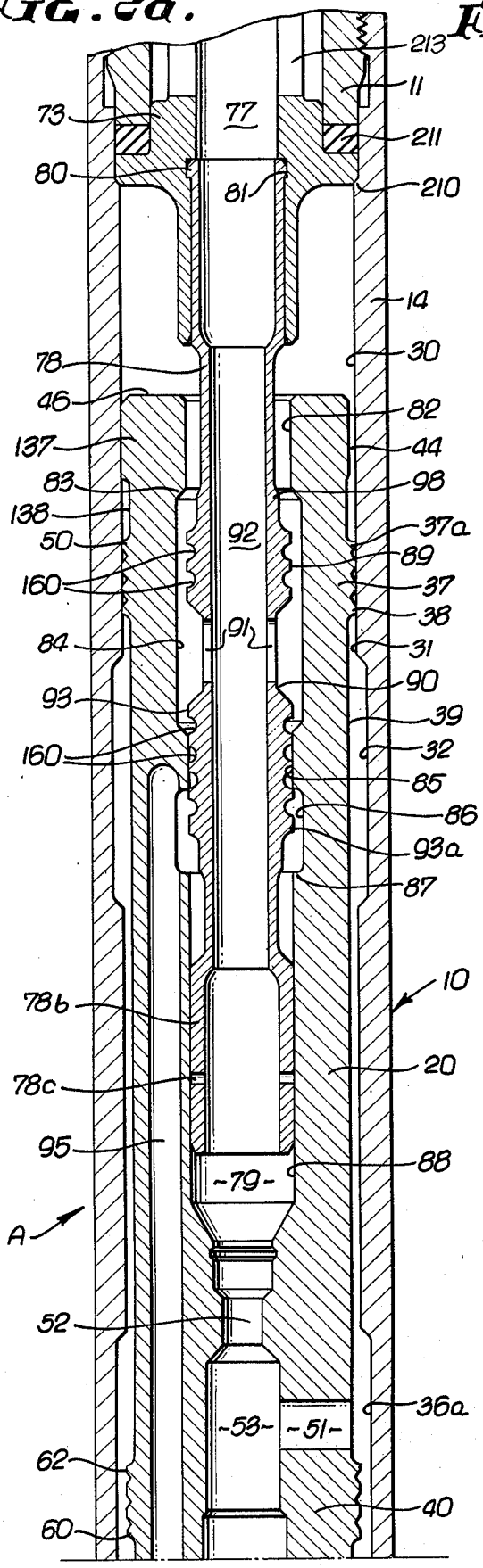
Figure 2B:
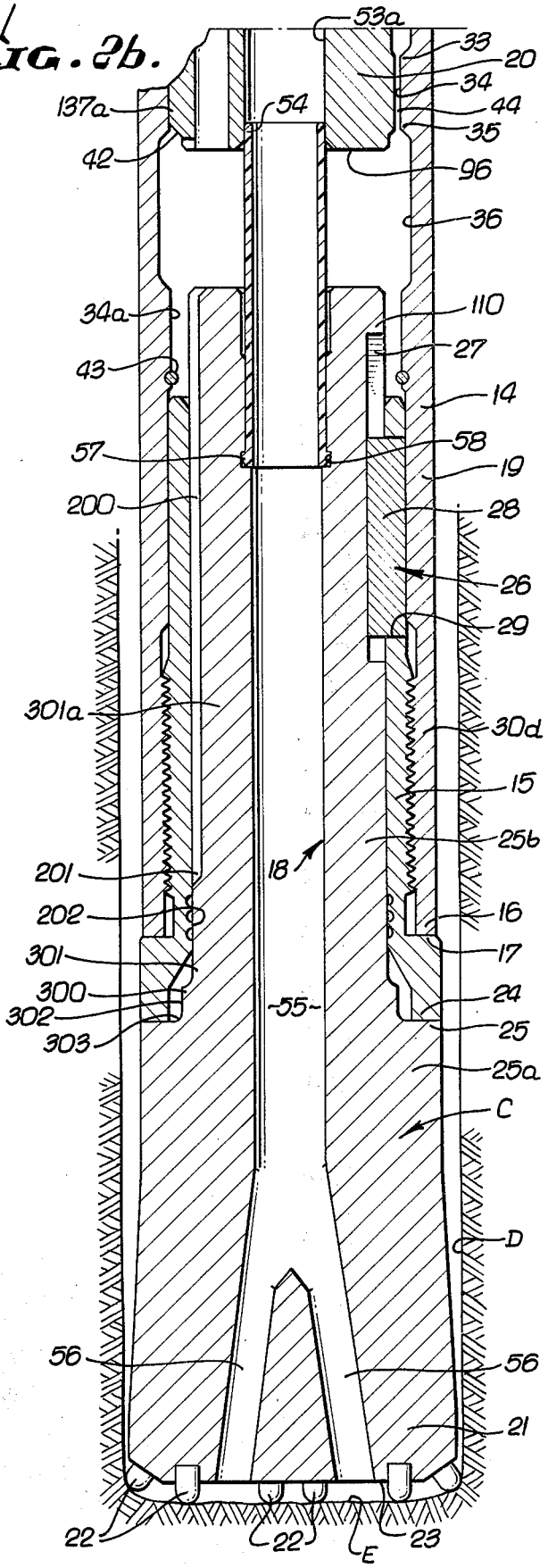
Figure 3A:
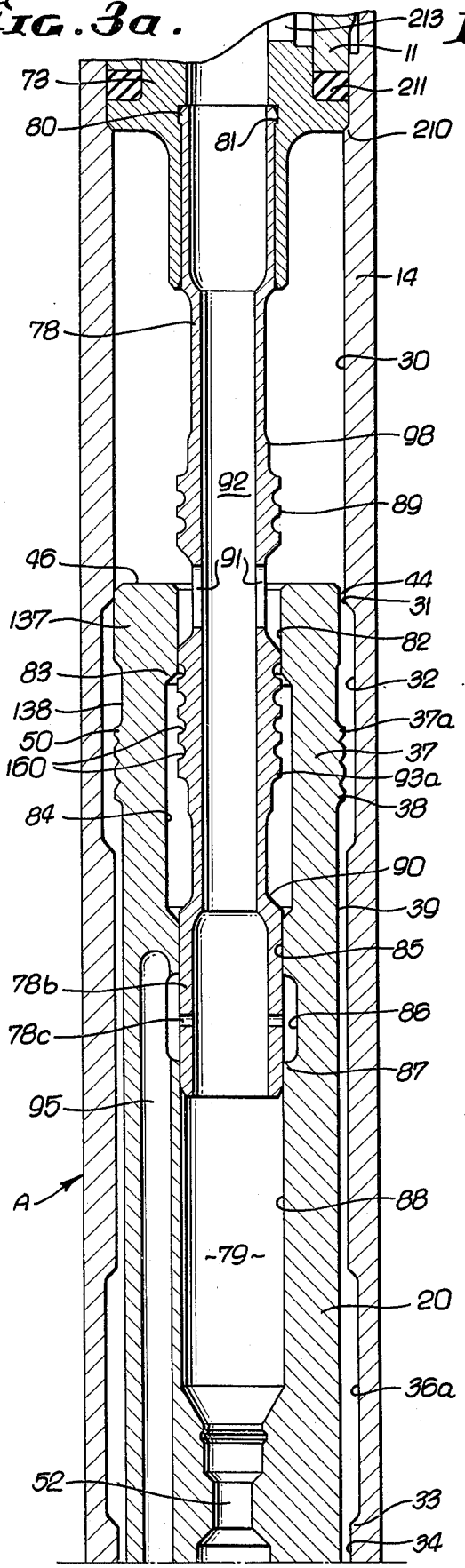
Figure 3B:
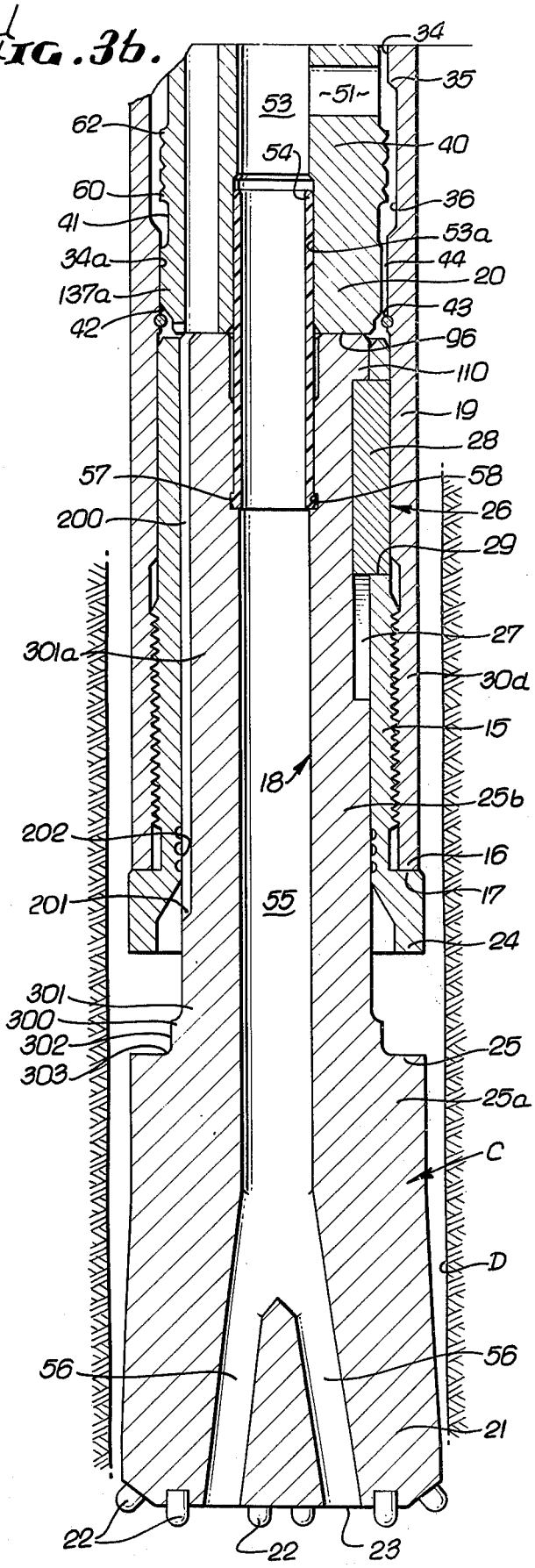

As described hereinbelow, in the event the apparatus is elevated to raise the bit 21 from the bottom E of the hole, the latter will drop downwardly until its upper anvil head shoulder 110 engages the upper ends of the segments or keys 28. This will allow the upper piston bypass corner 62 of the lower piston portion 40 to shift below the housing bypass corner 35 at the lower end of the lower inner cylindrical housing wall 34, the upper flow control piston corner being well below the upper housing flow control corner (FIGS. 3*a*, 3*b*). Accordingly, compressed air above the piston can flow through the passages 44 and the circumferentially exhaust grooves 32, 39, 36*a* into the air bypass groove 36 below the lower housing wall 34, the air passing downwardly through circumferentially spaced longitudinal internal grooves 200 in the anvil and bit, the lower ends 201 of the grooves having shifted from a closed position within the drive member 15 to an open position below the internal seal diameter 202 of the drive member, the air discharging from the open grooves into the bore hole to clean the space between the drive member 15 and head 25*a* of the bit of cuttings and reducing wear that normally occurs between these parts. The compressed air in the cylinder below the piston 20 is bled off promptly as a result of elevating the apparatus from the hole bottom, since the anvil bit C drops relatively downwardly of the housing structure to expose or open the lower ends 201 of the grooves through which the air bleeds into the open hole D. When the anvil 18 is in its upper position within the housing, and with the bit shoulder 25 engaging the lower end 24 of the drive member 15,, the lower ends of the grooves are sealed within the drive member 15 (FIGS. 1*c*, 2*b*).

Compressed air for reciprocating the hammer piston 20 passes downwardly through the string of drill pipe B and into the upper housing sub 11, flowing past a downwardly opening check valve 70, which may be in the form of a valve head 71 slidable within a valve counterbore 72 in a cylinder head 73 clamped between an upwardly facing housing shoulder 210 and the sub 11 through an intervening gasket seal 211, the head being movable upwardly to engage a companion seat 74 surrounding a central passage 75 through the seat, the downward movement of the valve head being limited by its engagement with the base 76 of the counterbore. With air being pumped downwardly through the apparatus, the head 71 is shifted downwardly from the seat, air flowing around the upper portion of the head and into an annular space 212 between the head and sub, and through cylinder head ports 213 into a central head passage 77. A spring 71*c* bears against the seat 76 at the lower end of the counterbore and engages the valve head 71 to urge it upwardly into engagement with its seat 74.

The inlet air under pressure is caused to flow alternately into the housing below the piston 20 and the housing above the piston, to effect reciprocation of the hammer piston. A housing inlet tube 78 is mounted in the cylinder head passage 77, projecting downwardly from the cylinder head 73 and into an upper elongate central piston cavity or chamber 79 above the intermediate passage restriction 52, which separates the upper chamber 79 from the lower chamber 53. The tube 78 is secured in the head 73 by an upper external flange 80 on the tube fitting within a companion internal circumferential groove 81 in the cylinder head. The inlet tube 78 is made of a flexible or elastic material, such as Delrin, which permits the upper portion of the tube to be deflected inwardly of the sub passage 77 below the circumferential groove 81, and when the flange 80 becomes aligned with the groove, the flange inherently expands outwardly into the groove to secure the tube to the cylinder head 73. The elastic nature of the tube is such that it also provides a slidable seal with the inner walls of the piston 20, as explained hereinbelow.

The piston has an elongate upper cylindrical surface 82 opening through its upper end 46 and terminating at an inner, upper flow control piston corner 83, which is the upper end portion of an elongate internal circumferential impact passage groove 84 having a substantially larger internal diameter than the inside diameter of the upper piston portion surface 82. The circumferential impact passage groove 84 terminates at an intermediate inner cylindrical piston wall 85, which may have the same internal diameter as the upper cylindrical piston wall 82, the intermediate wall terminating at an internal circumferential return passage groove 86 formed in the piston and terminating at a lower flow control piston corner 87, which is the upper end of a lower internal piston seal portion 88 that extends upwardly from the intermediate piston restriction 52.

The inlet tube 78 has an upper external cylindrical sealing surface 89 relatively slidably sealable with the upper piston wall 82 and terminating in an external circumferential inlet groove 90 communicating with radial inlet ports 91 that open to the central inlet passage 92 through the tube. Below this circumferential inlet groove 90, the tube is formed as a lower cylindrical sealing surface 93 slidably and sealingly engageable with the intermediate inner cylindrical piston wall 85. Labyrinth grooves 160 are provided in the tube surfaces 89 and 93 to enhance the sealing effectiveness of the surfaces 89, 93 with the walls 82, 85.

When the piston 20 is in its lowermost operative position, with the drill bit 21 pressed against the bottom E of the bore hole D, compressed air can flow downwardly through the inlet passage 92, discharging into the circumferential return passage 86 that communicates with the upper portion of one or more longitudinal return passages 95 extending downwardly through the hammer piston and opening outwardly through its lower end 96. When the hammer piston 20 moves upwardly within the housing 10 and along the inlet tube 78, the lower piston surface 85 first shifts upwardly over the flow control housing tube corner 93*a* to disrupt communication between the inlet passage 92 and the return passages 95, continued upward movement of the piston then placing the inner upper flow control piston corner 83 above the upper flow control housing tube corner 98, which then allows compressed air to flow from the inlet passage 92 through the ports 91 into the circumferential inlet groove 90 into the internal circumferential impact passage groove 84 and thence into the housing above the upper end 46 of the piston (FIGS. 2*a*, 2*b*). At this time, the upper piston corner 50 will have moved partially above the upper housing flow control corner 31, so that the air under pressure between the upper end 46 of the piston and the cylinder head 73 can act downwardly on the piston, urging it in a downward direction.

The piston 20 will be shifted downwardly until the upper flow control piston corner 83 moves below the flow control housing tube corner 98, which shuts off air pressure into the housing above the piston, the piston continuing to move downwardly as the compressed air expands, until the outer upper flow control piston corner 50 moves below the upper housing flow control corner 31, which then permits air above the piston to pass through the passages 44 into the circumferential exhaust grooves 32, 39, 36*a* and through the exhaust ports 51 and exhaust passages 53, 55, 56 to the bottom of the hole below the drill bit, the hammer piston being driven against the upper face 46 of the anvil to deliver an impact blow to the impact bit C. As the piston nears the end of its downward stroke, the lower piston wall 85 will move below the lower flow control housing tube corner 93*a*, thereby allowing the compressed air to flow from the inlet passage 92 through the ports 91 into the groove 84, flowing through the annular passage between the tube and wall 85 into the return passage groove 86, passing downwardly through the longitudinal return passages 95 to the lower end of the piston, such air then moving the piston in an upward direction, until the lower piston wall 85 passes upwardly beyond the lower flow control housing tube corner 93*a* once again, to shut off the flow of air into the return passages 95. When this occurs, the outer upper flow control piston corner 50 moves above the upper housing flow control corner 41 to shut off the exhaust of air from the housing region above the piston 20, the compressed air below the piston expanding and driving the hammer piston upwardly toward the head 73 of the housing. Before reaching the head, the inner upper flow control piston corner 83 will have shifted upwardly along the tube 78 to a position above the upper flow control housing tube corner 98, allowing air under pressure to pass from the inlet passage 92 through the impact passage grooves 90, 84 to a position in the housing above the piston 20.

The upward travel of the piston 20 is cushioned by the compression of the air remaining in the housing above the piston. However, the piston will still move upwardly sufficiently to place the lower corner 60 of the lower piston portion 40 above the housing lower flow control corner 33, which then permits the compressed air below the piston to travel into the internal circumferential exhaust groove 32 and through the exhaust ports 51 into the exhaust passages 53, 55, 56 for discharge from the drill bit. The compressed air in the housing structure above the piston then expands to drive the piston downwardly, and the foregoing cycle of operation is repeated, the piston reciprocating to deliver repeated impact blows against the anvil portion 18 of the anvil bit C, while the drill string B and the entire apparatus A is being rotated, to insure that the drilling or cutting elements 22 will cover substantially the entire cross-sectional area of the bore hole bottom E.

The hammer piston also has a lower guide portion 137*a* spaced downwardly from the lower piston portion 40 and slidable along the walls 34 and 34*a* below the groove 36 when the piston is approaching or is at its uppermost and lowermost positions. The lower guide also has the same relief portions 44 as the upper guide 137.

In the event it is desired to pump compressed air through the apparatus while the drill bit 21 is off bottom, elevation of the apparatus A will cause the impact bit C to drop downwardly along the housing until the upper anvil head 110 engages the upper ends of the keys 28 (FIGS. 3*a*, 3*b*). The piston 20 will also drop downwardly until its bypass corner 62 is below the bypass corner 35 of the housing 10, the upper corner 62 of the piston being disposed below the upper end of the internal circumferential groove 36. Accordingly, compressed air flowing downwardly through the drill string B and into the inlet passage 92 can pass through the inlet ports 91 and upwardly to a position above the piston, then flowing downwardly through the upper passages 44 and into the internal circumferential exhaust groove 32, flowing between the external circumferential exhaust groove 39 in the piston and the opposed lower inner cylindrical housing wall 34 into the enlarged diameter groove 36 below the inner cylindrical housing wall, then passing through the lower passages 44 in the lower guide 137*a* and through the bleeder grooves 200 to the exterior of the bit 21. The major portion of the compressed air will flow around the upper piston 37 through the grooves 32, 36*a*, ports 51 and passages 53, 55, 56 to the exterior of the bit 21, to clean the bore hole D of cuttings. The lower portion 78*b* of the tube 78 has radial ports 78*c* therethrough which communicate with the piston groove 86 when the bit 21 is off bottom (FIGS. 3*a*, 3*b*), in order that air can travel from the passage 92 through the ports 78*c* and groove 86, and through the return passage 95 and bleeder grooves 200 to the exterior of the bit.

It is to be noted that the shank 25*b* of the anvil bit does not extend downwardly to the upwardly facing bit shoulder 25, through which the drilling weight is transmitted from the housing structure 10 and its drive sub 15 to the bit 21, to force the buttons 22 against the bottom E of the formation during the drilling action. Instead, an intervening annular step 300 is provided which extends laterally from the lower end 301 of the cylindrical portion 301*a* of the shank thereabove, the rise 302 of the step then extending downwardly and merging into a fillet 303, which, in turn, merges smoothly into the bit shoulder 25 which is normal to the axis of the anvil bit. Heretofore, a cylindrical periphery of the shank extended downwardly to the bit head shoulder 25. As a result, the shank broke off at its junction with the head shoulder 25, limiting the useful service life of the bit. By way of example, breakage occurred after the bit had been used in drilling in excess of about 3,000 feet of bore hole. Such breakage is due to fatigue occurring at the shank-head junction, the fatigue being caused by the stress wave passing through the anvil bit between the upper end 46 of the anvil and the lower button face of the bit head.

By virtue of the step 300 provided between the bit head 25*a* and the lower end 301 of the shank, the stress wave referred to has been broken before it hits the intersection or junction between the shank and bit head, which reduces the induced stress at this point to a level where the fatigue life of the anvil bit C now exceeds the service life of the carbide buttons 22 projecting from the drilling face of the bit head.

We claim:

1. Percussion drilling apparatus for drilling a bore hole: comprising a housing structure connectible to a drill string; an anvil bit in the lower portion of said housing structure; said anvil bit being movable longitudinally of said housing structure; a hammer piston reciprocable in said housing structure for intermittently impacting against said anvil bit; means for directing a fluid medium under pressure into said housing structure above and below said hammer piston for action upon said piston to effect reciprocation of said piston in said housing structure; bleeder passage means in said anvil bit communicating with said housing structure below said piston; said passage means extending downwardly from an upper inlet portion opening through the upper extremity of said anvil bit to a lower outlet portion located above the lower end of said anvil bit; said housing structure including means for closing said outlet portion when said anvil bit is disposed relatively upwardly in said housing structure; said anvil bit being movable relatively downwardly of said housing structure upon elevation of said housing structure to dispose said outlet portion in open position below said closing means to permit fluid in said housing structure below said piston to flow through said bleeder passage means into the bore hole below said housing structure, said upper inlet portion remaining open when said outlet portion is in open position below said closing means.

2. Apparatus as defined in claim 1; said bleeder passage means including a longitudinal groove in the peripheral portion of said anvil bit extending form the upper extremity of said anvil bit and terminating at said outlet portion.

3. Apparatus as defined in claim 1; said bleeder passage means including circumferentially spaced longitudinal grooves in the peripheral portion of said anvil bit extending from the upper extremity of said anvil bit and terminating at said outlet portion.

4. Apparatus as defined in claim 1; said anvil bit including a cylindrical shank portion and a lower bit head shoulder engageable by the lower end of said housing structure; said bleeder passage means including a longitudinal groove in the peripheral portion of said shank portion and terminating at said outlet portion above said head shoulder; said closing means sealing against said peripheral portion below said outlet portion when said housing structure engages said shoulder; said outlet portion being disposed below said closing means upon elevation of said housing structure with respect to said anvil bit.

5. Apparatus as defined in claim 1; said anvil bit including a cylindrical shank portion and a lower bit head shoulder engageable by the lower end of said housing structure; said bleeder passage means including circumferentially spaced longitudinal grooves in the peripheral portion of said shank portion and terminating at said outlet portion above said head shoulder; said closing means sealing against said peripheral portion below said outlet portion when said housing structure engages said shoulder; said outlet portion being disposed below said closing means upon elevation of said housing structure with respect to said anvil bit.

6. Percussion drilling apparatus for drilling a bore hole: comprising a housing structure connectible to a drill string; an anvil bit in the lower portion of said housing structure, said anvil bit being movable longitudinally of said housing structure; a hammer piston reciprocable in said housing structure for intermittently impacting against said anvil bit; means for directing a fluid medium under pressure into said housing structure above and below said hammer piston for action upon said piston to effect reciprocation of said piston in said housing structure; bleeder passage means in said anvil bit communicating with said housing structure below said piston; said passage means extending downwardly from an upper inlet portion opening through the upper end of said anvil bit to a lower outlet portion located above the lower end of said anvil bit; said housing structure including means for closing said outlet portion when said anvil bit is disposed relatively upwardly in said housing structure; said anvil bit being movable relatively downwardly of said housing structure upon elevation of said housing structure to dispose said outlet portion in open position below said closing means to permit fluid in said housing structure below said piston to flow through said bleeder passage means into the bore hole below said housing structure; circumferentially spaced interengaging spline means on said housing structure and anvil bit permitting relative longitudinal movement of said anvil bit in said housing structure and for transmitting rotary motion from said structure to said anvil bit; said bleeder passage means being disposed arcuately to one side of said spline means.

7. Percussion drilling apparatus for drilling a bore hole: comprising a housing structure connectible to a drill string; an anvil bit in the lower portion of said housing structure; said anvil bit being movable longitudinally of said housing structure; a hammer piston reciprocable in said housing structure for intermittently impacting against said anvil bit; means for directing a fluid medium under pressure into said housing structure above and below said hammer piston for action upon said piston to effect reciprocation of said piston in said housing structure; bleeder passage means in said anvil bit communicating with said housing structure below said piston; said passage means extending downwardly from an upper inlet portion opening through the upper end of said anvil bit to a lower outlet portion located above the lower end of said anvil bit; said housing structure including means for closing said outlet portion when said anvil bit is disposed relatively upwardly in said housing structure; said anvil bit being movable relatively downwardly of said housing structure upon elevation of said housing structure to dispose said outlet portion in open position below said closing means to permit fluid in said housing structure below ssaid piston to flow through said bleeder passage means into the bore hole below said housing structure; said bleeder passage means including a longitudinal groove in the peripheral portion of said anvil bit extending from the upper end of said anvil bit and terminating at said outlet portion; said anvil bit having a longitudinal recess opening through its periphery; means including a drive segment relatively longitudinally slidable in said recess for transmitting rotary motion from said housing structure to said anvil bit; said longitudinal groove being arcuately displaced with respect to said longitudinal recess.

8. Percussion drilling apparatus for drilling a bore hole: comprising a housing structure connectible to a drill string; an anvil bit in the lower portion of said housing structure; said anvil bit being movable longitudinally of said housing structure; a hammer piston reciprocable in said housing structure for intermittently impacting against said anvil bit; means for directing a fluid medium under pressure into said housing structure above and below said hammer piston for action upon said piston to effect reciprocation of said piston in said housing structure; bleeder passage means in said anvil bit communicating with said housing structure below said piston; said passage means extending downwardly from an upper inlet portion opening through the upper end of said anvil bit to a lower outlet portion located above the lower end of said anvil bit; said housing structure including means for closing said outlet portion when said anvil bit is disposed relatively upwardly in said housing structure; said anvil bit being movable relatively downwardly of said housing structure upon elevation of said housing structure to dispose said outlet portion in open position below said closing means to permit fluid in said housing structure below said piston to flow through said bleeder passage means into the bore hole below said housing structure; said bleeder passage means including circumferentially spaced longitudinal grooves in the peripheral portion of said anvil bit extending from the upper end of said anvil bit and terminating at said outlet portion; said anvil bit having circumferentially spaced longitudinal recesses opening through its periphery; means including drive segments relatively longitudinally slidable in said recesses for transitting rotary motion from said housing structure to said anvil bit; said longitudinal grooves being disposed between said longitudinal recesses.

9. Percussion drilling apparatus for drilling a bore hole: comprising a housing structure connectible to a drill string; an anvil bit in the lower portion of said housing structure; said anvil bit being movable longitudinally of said housing structure; a hammer piston reciprocable in said housing structure for intermittently impacting against said anvil bit; means for directing a fluid medium under pressure into said housing structure above and below said hammer piston for action upon said piston to effect reciprocation of said piston in said housing structure; bleeder passage means in said anvil bit communicating with said housing structure below said piston; said passage means extending downwardly from an upper inlet portion opening through the upper end of said anvil bit to a lower outlet portion located above the lower end of said anvil bit; said housing structure including means for closing said outlet portion when said anvil bit is disposed relatively upwardly in said housing structure; said anvil bit being movable relatively downwardly of said housing structure upon elevation of said housing structure to dispose said outlet portion in open position below said closing means to permit fluid in said housing structure below said piston to flow through said bleeder passage means into the bore hole below said housing structure; said anvil bit including a cylindrical shank portion and a lower bit head shoulder engageable by the lower end of said housing structure; said bleeder passage means including a longitudinal groove in the peripheral portion of said shank portion and terminating at said outlet portion above said head shoulder; said closing means sealing against said peripheral portion below said outlet portion when said housing structure engages said shoulder; said outlet portion being disposed below said closing means upon elevation of said housing structure with respect to said anvil bit; said anvil bit having a longitudinal recess opening through its periphery; means including a drive segment relatively longitudinally slidable in said recess for transmitting rotary motion from said housing structure to said anvil bit; said longitudinal groove being arcuately displaced with respect to said longitudinal recess.

10. Apparatus as defined in claim 9; said anvil bit having a circumferential step extending laterally outwardly from the lower end of said shank portion and terminating at the inner end of said bit shoulder.

11. Percussion drilling apparatus for drilling a bore hole: comprising a housing structure connectible to a drill string; an anvil bit in the lower portion of said housing structure; said anvil bit being movable longitudinally of said housing structure; a hammer piston reciprocable in said housing structure for intermittently impacting against said anvil bit; means for directing a fluid medium under pressure into said housing structure above and below said hammer piston for action upon said piston to effect reciprocation of said piston in said housing structure; bleeder passage means in said anvil bit communicating with said housing structure below said piston; said passage means extending downwardly from an upper inlet portion opening through the upper end of said anvil bit to a lower outlet portion located above the lower end of said anvil bit; said housing structure including means for closing said outlet portion when said anvil bit is disposed relatively upwardly in said housing structure; said anvil bit being movable relatively downwardly of said housing structure upon elevation of said housing structure to dispose said outlet portion in open position below said closing means to permit fluid in said housing structure below said piston to flow through said bleeder passage means into the bore hole below said housing structure; said anvil bit including a cylindrical shank portion and a lower bit heat shoulder engageable by the lower end of said housing structure; said bleeder passage means including circumferentially spaced longitudinal grooves in the peripheral portion of said shank portion and terminating at said outlet portion above said head shoulder; said closing means sealing against said peripheral portion below said outlet portion when said housing structure engages said shoulder; said outlet portion being disposed below said closing means upon elevation of said housing structure with respect to said anvil bit; said anvil bit having circumferentially spaced longitudinal recesses opening through its periphery; means including drive segments relatively longitudinally slidable in said recesses for transmitting rotary motion from said housing structure to said anvil bit; said longitudinal grooves being disposed between said longitudinal recesses.

12. Apparatus as defined in claim 11; said anvil bit having a circumferential step extending laterally outwardly from the lower end of said shank portion and terminating at the inner end of said bit shoulder.

13. Percussion drilling apparatus for drilling a bore hole: comprising a housing structure connectible to drill string; an anvil bit in the lower portion of said housing structure; said anvil bit being movable longitudinally of said housing structure; a hammer piston reciprocable in said housing structure for intermittently impacting against said anvil bit; means for directing a fluid medium under pressure into said housing structure above and below said hammer piston for action upon said piston to effect reciprocation of said piston in said housing structure; bleeder passage means in said anvil bit communicating with said housing structure below said piston; said passage means extending downwardly from an upper inlet portion opening through the upper end of said anvil bit to a lower outlet portion located above the lower end of said anvil bit; said housing structure including means for closing said outlet portion when said anvil bit is disposed relatively upwardly in said housing structure; said anvil bit being movable relatively downwardly of said housing structure upon elevation of said housing structure to dispose said outlet portion in open position below said closing means to permit fluid in said housing structure below said piston to flow through said bleeder passage means into the bore hole below said housing structure; said anvil bit including a cylindrical shank portion and a lower bit head shoulder engageable by the lower end of said housing structure; said bleeder passage means including a longitudinal groove in the peripheral portion of said shank portion and terminating at said outlet portion above said head shoulder; said closing means sealing against said peripheral portion below said outlet portion when said housing structure engages said shoulder; said outlet portion being disposed below said closing means upon elevation of said housing structure with respect to said anvil bit; said anvil bit having a circumferentially continuous step extending laterally outwardly from the lower end of said shank portion below said peripheral portion and terminating at the inner end of said bit shoulder.

14. Percussion drilling apparatus for drilling a bore hole: comprising a housing structure connectible to a drill string; an anvil bit in the lower portion of said housing structure; said anvil bit being movable longitudinally of said housing structure; a hammer piston reciprocable in said housing structure for intermittently impacting against said anvil bit; means for directing a fluid medium under pressure into said housing structure above and below said hammer piston for action upon said piston to effect reciprocation of said piston in said housing structure; bleeder passage means in said anvil bit communicating with said housing structure below said piston; said passage means extending downwardly from an upper inlet portion opening through the upper end of said anvil bit to a lower outlet portion located above the lower end of said anvil bit; said housing structure including means for closing said outlet portion when said anvil bit is disposed relatively upwardly in said housing structure; said anvil bit being movable relatively downwardly of said housing structure upon elevation of said housing structure to dispose said outlet portion in open position below said closing means to permit fluid in said housing structure below said piston to flow through said bleeder passage means into the bore hole below said housing structure; said anvil bit including a cylinderical shank portion and a lower bit head shoulder engageable by the lower end of said housing structure; said bleeder passage means including circumferentially spaced longitudinal grooves in the peripheral portion of said shank portion and terminating at said outlet portion above said head shoulder; said closing means sealing against said peripheral portion below said outlet portion when said housing structure engages said shoulder; said outlet portion being disposed below said closing means upon elevation of said housing structure with respect to said anvil bit; said anvil bit having a circumferentially continuous step extending laterally outwardly from the lower end of said shank portion below said peripheral portion and terminating at the inner end of said bit shoulder.

15. Percussion drilling apparatus: comprising an anvil bit adapted to be impacted against by a hammer piston; said anvil bit having bleeder passage means including an upper inlet portion opening through the upper extremity of said anvil bit, said passage means extending downwardly in said anvil bit to a lower outlet portion located above the lower end of said anvil bit; said anvil bit having a peripheral sealing portion below said lower outlet portion adapted to be sealed against by a housing structure when said bit is disposed therein.

16. Apparatus as defined in claim 15; said bleeder passage means including a longitudinal groove in the peripheral portion of said anvil bit extending from the upper extremity of said anvil bit and terminating at said outlet portion.

17. Apparatus as defined in claim 15; said bleeder passage means including circumferentially spaced longitudinal grooves in the peripheral portion of said anvil bit extending from the upper extremity of said anvil bit and terminating at said outlet portion.

18. Apparatus as defined in claim 15; said anvil bit including a cylindrical shank portion and a lower bit head shoulder engageable by the lower end of said housing structure; said bleeder passage means including a longitudinal groove in the peripheral portion of said shank portion extending from the upper extremity of said anvil bit and terminating at said outlet portion above said shoulder; said sealing portion being disposed above said shoulder.

19. Apparatus as defined in claim 15; said anvil bit including a cylindrical shank portion and a lower bit head shoulder engageable by the lower end of said housing structure; said bleeder passage means including circumferentially spaced longitudinal grooves in the peripheral portion of said shank portion extending from the upper extremity of said anvil bit and terminating at said outlet portion above said head shoulder; said sealing portion being disposed above said shoulder.

20. Apparatus as defined in claim 15; said bleeder passage means including a longitudinal groove in the peripheral portion of said anvil bit extending from the upper extremity of said anvil bit and terminating at said outlet portion; said anvil bit having a longitudinal recess opening through its periphery and adapted to receive a rotary drive segment; said longitudinal groove being arcuately displaced with respect to said longitudinal recess.

21. Percussion drilling apparatus: comprising an anvil bit adapted to to be impacted against by a hammer piston; said anvil bit having bleeder passage means including an upper inlet portion opening through the upper end of said anvil bit, said passage means extending downwardly in said anvil bit to a lower outlet portion located above the lower end of said anvil bit; said anvil bit having a peripheral sealing portion below said lower outlet portion adapted to be sealed against by a housing structure when said bit is disposed therein; said bleeder passage means including circumferentially spaced longitudinal grooves in the peripheral portion of said anvil bit extending from the upper end of said anvil bit and terminating at said outlet portion; said anvil bit having circumferentially spaced longitudinal recesses opening through its periphery and adapted to receive rotary drive segments; said longitudinal grooves being disposed between said longitudinal recesses.

22. Percussion drilling apparatus: comprising an anvil bit adapted to be impacted against by a hammer piston; said anvil bit having bleeder passage means including an upper inlet portion opening through the upper end of said anvil bit, said passage means extending downwardly in said anvil bit to a lower outlet portion located above the lower end of said anvil bit; said anvil bit having a peripheral sealing portion below said lower outlet portion adapted to be sealed against by a housing structure when said bit is disposed therein; said anvil bit including a cylindrical shank portion and a lower bit head shoulder engageable by the lower end of said housing structure; said bleeder passage means including a longitudinal groove in the peripheral portion of said shank portion extending from the upper end of said anvil bit and terminating at said outlet portion above said shoulder; said sealing portion being disposed above said shoulder; said anvil bit having a longitudinal recess opening through its periphery and adapted to receive a rotary drive segment; said longitudinal groove being arcuately displaced with respect to said longitudinal recess.

23. Apparatus as defined in claim 22; said anvil bit having a circumferential step extending laterally outwardly from the lower end of said shank portion and terminating at the inner end of said bit shoulder.

24. Percussion drilling apparatus: comprising an anvil bit adapted to be impacted against by a hammer piston; said anvil bit having bleeder passage means including an upper inlet portion opening through the upper end of said anvil bit, said passage means extending downwardly in said anvil bit to a lower outlet portion located above the lower end of said anvil bit; said anvil bit having a peripheral sealing portion below said lower outlet portion adapted to be sealed against by a housing structure when said bit is disposed therein; said anvil bit including a cylinderical shank portion and a lower bit head shoulder engageable by the lower end of said housing structure; said bleeder passage means including circumferentially spaced longitudinal grooves in the peripheral portion of said shank portion extending from the upper end of said anvil bit and terminating at said outlet portion above said head shoulder; said sealing portion being disposed above said shoulder; said anvil bit having circumferentially spaced longitudinal recesses opening through its periphery and adapted to receive rotary drive segments; said longitudinal grooves being disposed between said longitudinal recesses.

25. Apparatus as defined in claim 24; said anvil bit having a circumferential step extending laterally outwardly from the lower end of said shank portion and terminating at the inner end of said bit shoulder.

26. Percussion drilling apparatus: comprising an anvil bit adapted to be impacted against by a hammer piston, said anvil bit including a cylindrical shank portion extending continuously downwardly from the upper end of said bit and a lower bit head shoulder engageable by the lower end of a housing structure; said anvil bit further having a circumferentially continuous step extending laterally outwardly beyond the periphery of said shank portion from the lower end of said shank portion and terminating at the inner end of said bit shoulder.

* * * * *